United States Patent [19]

Farina

[11] 4,195,372

[45] Apr. 1, 1980

[54] AUTOMATIC SEAT RETURN SPRING FOR RELATIVELY PIVOTED TOILET SEAT AND COVER ASSEMBLIES

[75] Inventor: Minnie Farina, Hialeah, Fla.

[73] Assignees: Nancy Schroeder; Emilio Joseph Farina, both of Miami, Fla.

[21] Appl. No.: 691,852

[22] Filed: Jun. 1, 1976

[51] Int. Cl.[2] ..... A47K 3/10; A47C 7/62

[52] U.S. Cl. ..... 4/234; 4/240; 4/251; 16/85; 16/145; 297/193; 297/333

[58] Field of Search ..... 4/234, 236, 240, 239, 4/248, 251; 16/159, 189, 85, 145; 52/760; 297/193, 331–333

[56] References Cited

U.S. PATENT DOCUMENTS 3,653,077 4/1972 Warnberg ..... 4/236

OTHER PUBLICATIONS

"Springs" by Terry, London, England, Mar. 1948.

*Primary Examiner*—Stuart S. Levy

*Attorney, Agent, or Firm*—Ernest H. Schmidt

[57] ABSTRACT

A leaf spring integrally formed of resilient sheet material has a transverse, substantially tubular arcuate intermediate portion terminating in opposed, laterally outwardly-extending, substantially flat abutment leaf portions. The tubular portion of the spring is adapted to be circumjacently received about the pintle rod of the usual hinge mechanism hingingly interconnecting the seat with the cover of an ordinary toilet seat assembly, with one leaf member abutting a rear portion at the inside of the seat and the other leaf member abutting a rear portion at the inside of the cover, to resiliently constrain the seat in down position against the reactive force of the cover when in its uppermost or open position, so that the seat can only be withdrawn from bowl position by manual lifting against the reactive force of the spring.

2 Claims, 3 Drawing Figures

Figure 1:
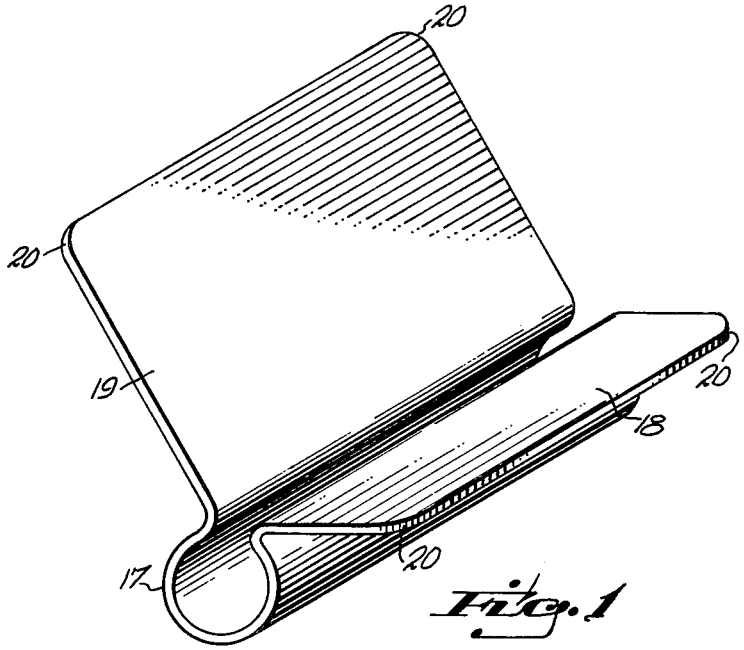

AUTOMATIC SEAT RETURN SPRING FOR RELATIVELY PIVOTED TOILET SEAT AND COVER ASSEMBLIES

This invention is directed to hinged toilet seat assemblies comprising a bowl seat and seat cover, and is directed particularly to an attachment spring for use with such seat assemblies for normally resiliently retaining the seat in down or bowl position so that it cannot be left in the withdrawn or upward position.

A common difficulty with free-swinging toilet seat assemblies is that the seat and cover are both often left in the upward or withdrawn position so that the next user of the commode in seating position must first lower the seat. If the user happens to be inattentive or sleepy, which is particularly likely to have happen during the nighttime when lighting is diminished, he or she not uncommonly will inadvertently sit directly on the rim of the bowl before realizing that the seat was not in place. It is, accordingly, the principal object of this invention to obviate such discomfiture by the provision of resilient means normally retaining the seat member of the seat and cover assembly in the downward or seating position.

A more particular object of the invention is to provide an automatic seat return spring for relatively pivoted toilet seat and cover assemblies that can readily be applied circumjacent the pintal rod of the usual seat assembly hinge mechanism and comprises an open-loop or arcuate tubular portion extending into a pair of laterally-opposed leaf members, the open loop tubular portion being adapted to be circumjacently received along the pintal rod of the toilet seat assembly with one leaf abutting at the rear against the inside of the seat member, and the other leaf member abutting at the rear against the inside of the cover member, so as to resiliently constrain the seat in down position against the reactive force of the cover when in its uppermost or open position, whereby the seat can only be lifted from the seated or bowl position by manual lifting against the reactive force of the spring.

Another object of the invention is to provide an automatic seat return spring of the character described which will be simple in construction, inexpensive to manufacture, easy to install and remove, and durable and inconspicuous in use.

Figure 2:
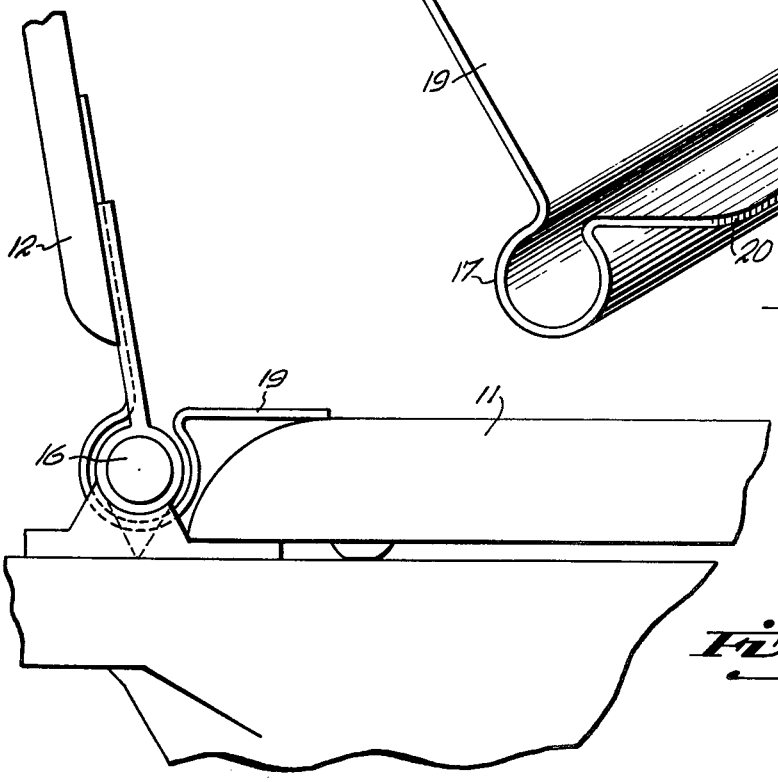
Figure 3:
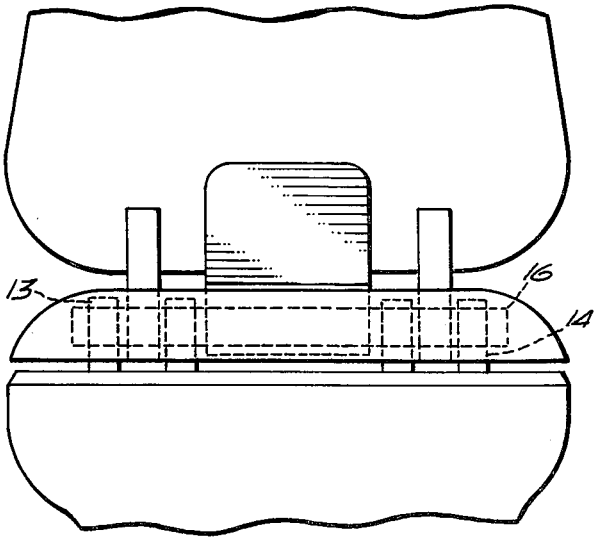

Other objects, features and advantages of the invention will be apparent from the following description when read with reference to the accompanying drawings. In the drawings, wherein like reference numerals denote corresponding parts throughout the several views:

FIG. 1 illustrates, in oblique view as seen from the front, an automatic seat returning spring embodying the invention;

FIG. 2 illustrates in side elevation the seat return spring of FIG. 1 shown in use as applied to the hinge mechanism of a toilet seat and cover assembly, the associated toilet bowl, seat and cover being partially illustrated; and FIG. 3 is a front elevational view of the bowl and seat assembly of FIG. 2, further illustrating the use of the automatic seat return spring embodying the invention in retaining the seat member in down or seated position.

Referring now in detail to the drawing, reference numeral 10 designates, generally, a preferred form of automatic seat return spring embodying the invention, the same being shown fitted to the hinge mechanism of an ordinary toilet seat assembly comprising a seat member 11 and cover member 12 (partially illustrated). The hinge means of the toilet seat assembly comprises a pair of spaced hinges 13, 14 secured to a back portion of the toilet bowl 15 and inter-joined by a common pintle rod 16. The automatic seat return spring 10, as is hereinafter more particularly described, is circumjacently received about a central portion of the seat hinge assembly pintle 16, which serves to inconspicuously retain it in place.

Referring to FIG. 1, it will be seen that the seat return spring 10 is integrally formed of a flat sheet material such as spring steel, for example, and comprises an intermediate, arcuately-bent portion 17 extending just short of a full circle to terminate at one side in a reversely-bent seat abutment leaf portion 18 of substantially rectangular configuration, and at the other side in an opposed, outwardly-bent cover abutment leaf portion 19, also of substantially rectangular shape, but of somewhat greater width or lateral extension. As best illustrated in FIG. 2, the seat abutment leaf portion 18 is outwardly bent to define an acute angle in the reverse direction with respect to the arcuately-bent portion 17, and the cover abutment leaf portion 19 is outwardly bent to define an obtuse angle in the reverse direction with respect to said arcuately bent portion. The outer corners of the seat and cover abutment leaf portions 18 and 19, respectively, will preferably be rounded, as indicated at 20. The internal diameter of the arcuately bent portion 17 of the automatic seat return spring 10 will be somewhat greater than the diameter of the seat assembly hinge pintle 16, so as to freely receive said pintle. The length of the automatic seat return spring 10, moreover, will be somewhat less than the distance between the spaced hinges 13, 14, as best illustrated in FIG. 3, to permit ready attachment for the use.

Upon installation, the abutment leaf portions 18 and 19 will be manually pressed together to permit their insertion, from behind the pintal 16, in overlapping relation with respect to the top of the seat member 11 of toilet seat assembly and the inner surface of the cover member 12 thereof respectively. While this is being accomplished, pressure against the back of the pintle 16 will at the same time cause the gap in the arcuately bent portion 17 to spread sufficiently to permit snap passage of said pintle into the cylindrical recess defined by said arcuately bent portion. As illustrated in FIG. 2, the automatic seat return spring 10 will be so stressed as to resiliently maintain the seat member 11 in its down position, seated against the toilet bowl 15, while at the same time constraining the cover member 12 in open abutting relation against the tank or other vertical surface behind the toilet bowl assembly. It will be understood that the cover abutment leaf portion 19, upon upward manual swinging of the seat member 11 about its hinge mechanism, will serve to "wind" the spring loop comprising the arcuately bent portion 17 of the seat return spring 10 to somewhat increase the reactive stress upon the seat cover 11 upon its being lifted, thereby insuring that it will always return automatically to seated position upon manual release.

The principal advantage of the invention resides in the fact that when not in use, the toilet seat 11 will always be in down position upon the toilet bowl, thereby eliminating the possibility of inadvertantly sitting on the toilet bowl rim instead of the seat.

Another advantage of the invention resides in its use as a training device for those who would otherwise unthinkingly leave the toilet seat in its lifted or retracted position.

While there is illustrated and described herein only one form in which the invention can conveniently be embodied in practice, it is to be understood that this embodiment is given by way of example and not in a limiting sense. Thus, while I have described the spring material as being of spring steel, it could as well be of any sheet material having the required strength and resiliency such, for example, as hard rubber or synthetic plastic material. The invention, in brief, comprises all the embodiments and modifications coming within the scope and spirit of the following claims.

What is claimed as new and for which it is desired to secure Letters Patent is:

1. An automatic seat return spring mechanism comprising, a toilet seat and seat cover, relative hinging means for said seat and cover comprising a pair of spaced hinge members having a common pintle extending therebetween, a tempered sheet metal leaf spring integrally formed with a transverse arcuate portion partially surrounding the hinge pintle at the outside thereof, said arcuate portion merging with first and second laterally-outwardly-extending abutment leaf portions abutting, respectively, a rear portion at the inside of the seat and a rear portion at the inside of the cover, whereby the seat will be resiliently constrained in the downward position against the reactive force imposed by the cover, said transverse arcuate portion being of substantially tubular configuration extending just short of a full circle, said first abutment leaf portion being reversely bent to define an acute angle with respect to the outside of said arcuately formed portion, and said second abutment leaf portion being outwardly bent to define an obtuse angle with respect to the outside of said arcuately formed portion.

2. An automatic seat return spring as defined in claim 1, wherein said abutment leaf portions are of substantially rectangular configuration.

* * * * *